United States Patent [19]

Bucksbaum

[11] 4,137,441

[45] Jan. 30, 1979

[54] MICROWAVE OVEN DOOR SEAL SYSTEM

[75] Inventor: Arnold M. Bucksbaum, Cedar Rapids, Iowa

[73] Assignee: Amana Refrigeration, Inc., Amana, Iowa

[21] Appl. No.: 795,580

[22] Filed: May 10, 1977

Related U.S. Application Data

[63] Continuation of Ser. No. 563,935, Mar. 31, 1975, abandoned.

[51] Int. Cl.[2] ..... H05B 9/06

[52] U.S. Cl. ..... 219/10.55 D

[58] Field of Search ..... 219/10.55 R, 10.55 D, 219/10.55 F

[56] References Cited

U.S. PATENT DOCUMENTS

| | | | |
|---|---|---|---|
| 3,668,357 | 6/1972 | Kobayashi | 219/10.55 D |
| 3,767,884 | 10/1973 | Osepchuk et al. | 219/10.55 D |
| 4,053,731 | 10/1977 | Foerstner | 219/10.55 D |

*Primary Examiner*—Arthur T. Grimley

*Attorney, Agent, or Firm*—M. D. Bartlett; J. D. Pannone; H. W. Arnold

[57] ABSTRACT

A microwave oven having a door with a peripheral microwave seal structure which is fabricated from one or more die formed aluminum parts and solid dielectric inserts to form a resonant transmission line structure with peripheral oven wall portions, with transmission of microwave energy in the seal around the periphery of the door prevented by impedance discontinuities, and leakage of microwave energy through the seal is prevented by impedance mismatch or resonant choke action of the seal structure, and the size of a notch in a solid dielectric insert in a quarter wavelength shorted branch line of the seal is selected for different production runs of the oven to compensate for dimensional changes in different die stamped metal parts or assembled door structures due to assembly jig changes, stamping die wear or assembly procedures.

13 Claims, 7 Drawing Figures

FIG. 6
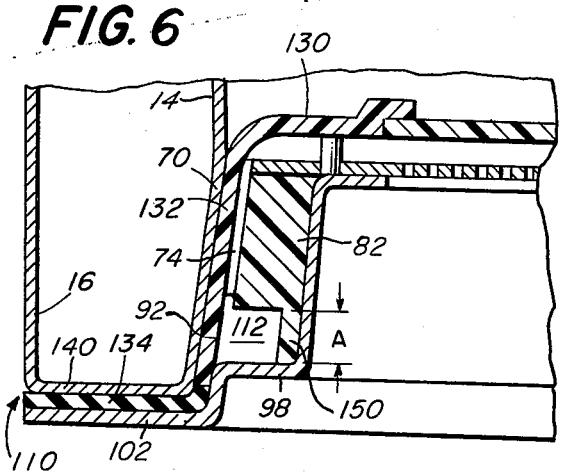
FIG. 4
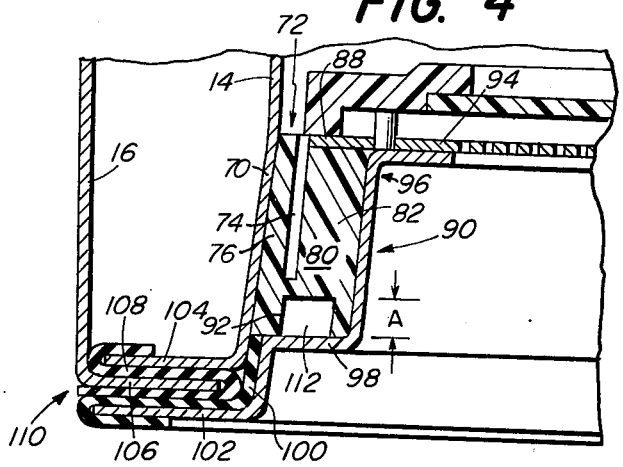
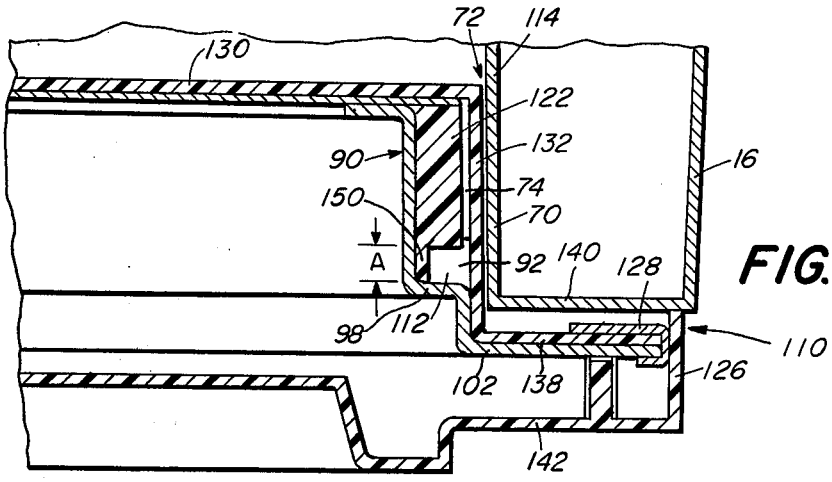
FIG. 7
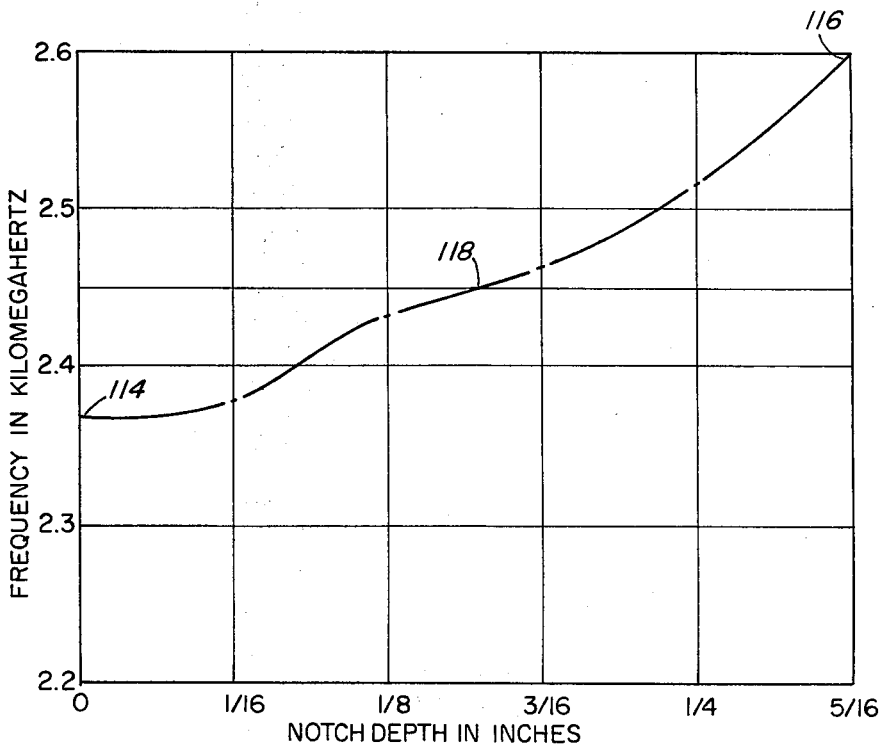
FIG. 5

MICROWAVE OVEN DOOR SEAL SYSTEM

CROSS-REFERENCE TO RELATED CASES

This is a continuation of application Ser. No. 563,935, filed Mar. 31, 1975, now abandoned, entitled Microwave Oven Door Seal System.

BACKGROUND OF THE INVENTION

The patent to Ironfield, U.S. Pat. No. 3,182,164, issued May 4, 1965, entitled "Electromagnetic Energy Seal," discloses a microwave oven having an oven door with a radiation for inhibiting the leakage of microwave energy from the oven around the periphery of the door. The seal utilizes an input section from the oven in which the door conductive wall is spaced from the oven conductive wall and constitutes a transmission line from the oven interior to a region of coupling to a branch transmission line coupled to the input section at a point approximately a quarter wavelength at the microwave energy supply frequency along said input transmission line section from the oven end of said input section. The branch transmission line is shorted by a conductive end plate at a point approximately a quarter wavelength from the coupling to the input transmission line and, hence, reflects a short circuit to the oven end of the input transmission line section at a distance of one-half wavelength from the shorted end of the branch transmission line.

Such a structure may be also considered as an open circuit or high impedance reflected from the shorted end of the branch transmission line to its point of junction with the main transmission line, such open circuit being in series with one of the walls of the input transmission line at the point of junction, hence inhibiting the further transmission of energy along the transmission line and out of the oven. This reduces the electrical effect of various structures connected to the output region of the transmission line or the outer peripheral portion of the door.

The peripheral impedance discontinuities, as shown in U.S. Pat. No. 3,767,884 issued Oct. 23, 1973 to John D. Osepchuk and James E. Simpson, prevent peripheral transmission of energy in the seal and permit use of transmission line dimensions which can be accurately matched to the microwave frequency since dimensions transverse to the seal periphery predominantly control the resonant or impedance mismatch of the seal structure.

In production, the metallic parts of the door are preferably fabricated as die formed parts, such as metal stampings or castings, and die tolerances will produce variations in the resonant frequencies of the choke action which for high Q materials may cause some of the oven seals to fall outside allowable radiation standards. In addition, when ovens are in service, bending of the door hinge or other parts can cause conditions where leakage is beyond standards. Hence, it is desirable to set the production run so that leakage is minimized for the worst case to be encountered. An example of a worst case is the condition when a door is slightly opened with the oven energized before an interlock deenergizes the power supply. Since changes in the dies for stampings or molding of metal or plastic are economically undesirable, it is desirable to have another means of altering the electrical wavelength of the seal on a product run basis.

SUMMARY OF THE INVENTION

This invention provides for a microwave radiation seal surrounding an interior region excited by microwave energy which prevents leakage of energy through the seal wherein relatively movable conductive surfaces form an input transmission line section communicating with said interior region and coupled to a branch line section at a high impedance region which is substantially a quarter wavelength from a short circuit in said branch line, with major portions of the input and the branch line sections being filled with a solid dielectric and a portion of a region in the branch line adjacent to said coupling region having a lower dielectric constant than said solid dielectric or lower than the average dielectric constant of the dielectric medium of said branch line.

This invention further provides that such a door structure for a microwave oven can be formed with portions of the metal walls of the door production die stamped or, if preferred, die cast, and the effective electrical dimensions of the branch line may be selected by selecting the size of a notch in the solid dielectric in the high impedance region of the branch line and adjacent to the coupling region between the input and branch line sections or between the input and output sections of the seal system.

This invention further provides that a dielectric stamped cover may be placed over the metal portions of the door with integral extensions forming the solid dielectric in the input section and/or output sections.

This invention further provides that an output section of the seal structure may be formed with either a resistive load or a reactive load to further inhibit the leakage of energy around the periphery of the seal region in the input section to substantially prevent coupling of the seal input section to any of a plurality of microwave energy resonant modes existing in the interior of the oven cavity at the frequency of excitation of the cavity by a microwave generator such as a magnetron for any direction of propagation other than substantially transverse to the seal where the effective choking action by the shorted $\lambda/4$ branch line coupled to the input section can be adjusted to reflect the short circuit of the branch guide one-half wavelength back through the coupling region to the cavity end of the input section.

As used throughout the specification and claims, the term "wavelength" or "electrical wavelength" means the effective electrical wavelength of the microwave energy in the structure such as the seal which, in general, will be less than the free space wavelength due to modification of the velocity of the wave by the structure dimensions and the dielectric constant of dielectric mediums in the structure having a dielectric constant greater than unity. The term "free space wavelength" means the wavelength of the radiated microwave energy in free space which is substantially the condition in the interior of the oven.

This invention further provides for die forming portions of the branch line wall with dimensions such that with the branch line substantially filled with a solid dielectric having a dielectric constant greater than one, the seal will be resonant slightly below the desired frequency. A portion of the solid dielectric preferably adjacent to the region of coupling of the branch guide to the input section is omitted to form a notch which raises the frequency of the seal structure to the desired frequency. Preferably, the frequency is selected for the worst case of door misadjustment or for having the door opened to the point where the interlock has just deenergized the microwave source. Thus, the resonant frequency of the microwave seal which is selected by selecting the size of the notch of the solid dielectric insert in the branch line may be altered for a particular production run where dimensional changes of stamped parts have occurred between production runs due, for example, to stamping die wear, jig setup changes, or shifts in production specifications. This invention is particularly useful when production dies wear and a second production run from a given set of dies will produce a different resonant frequency for the branch line than the first run.

BRIEF DESCRIPTION OF THE DRAWINGS

Other and further objects and advantages of the invention will become apparent as the description thereof progresses, reference being had to the accompanying drawings wherein:

FIG. 4 is an expanded sectional view of a cross section of the seal region of the structure shown in FIGS. 1 through 3 illustrating the composite dielectric structure of one embodiment of the invention;

FIG. 5 illustrates a graph showing variation in frequency with dielectric dimensions for the embodiment of the invention illustrated in FIGS. 1 through 4;

FIG. 6 is a cross-sectional view of a further embodiment of the invention wherein the dielectric cover is formed integral with a solid dielectric portion of the seal input region; and FIG. 7 illustrates a further embodiment of the invention wherein the dielectric cover extends through both the seal input and output regions.

DESCRIPTION OF THE PREFERRED EMBODIMENT

Figure 1:
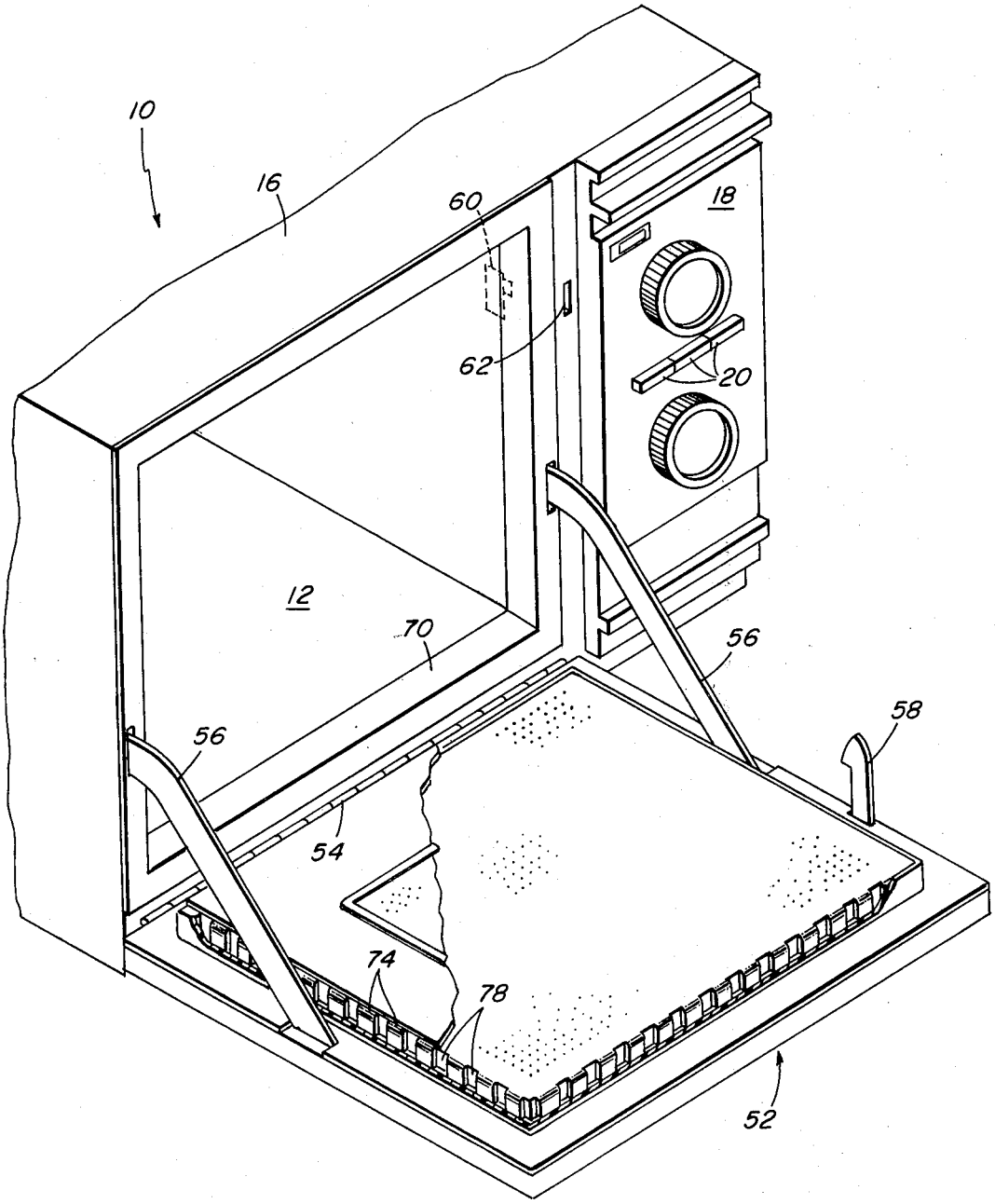
FIG. 1 is a perspective partially broken away view of a microwave oven and control system embodying the invention.
Figure 2:
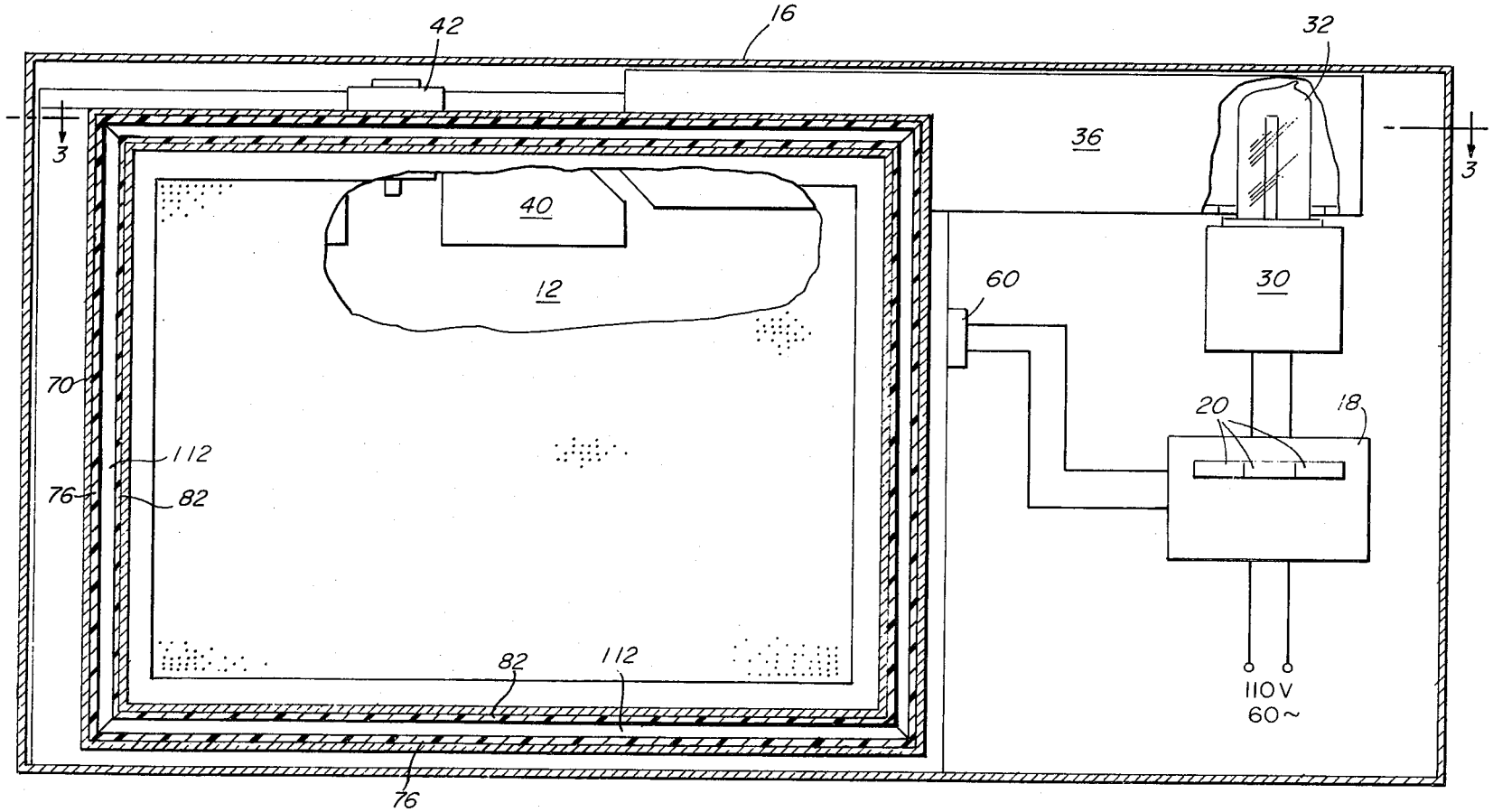
FIG. 2 is a transverse cross-sectional view of the oven of FIG. 1 taken along line 2—2 of FIG. 3 showing details of the oven door, microwave feed and mode stirring structure.
Figure 3:
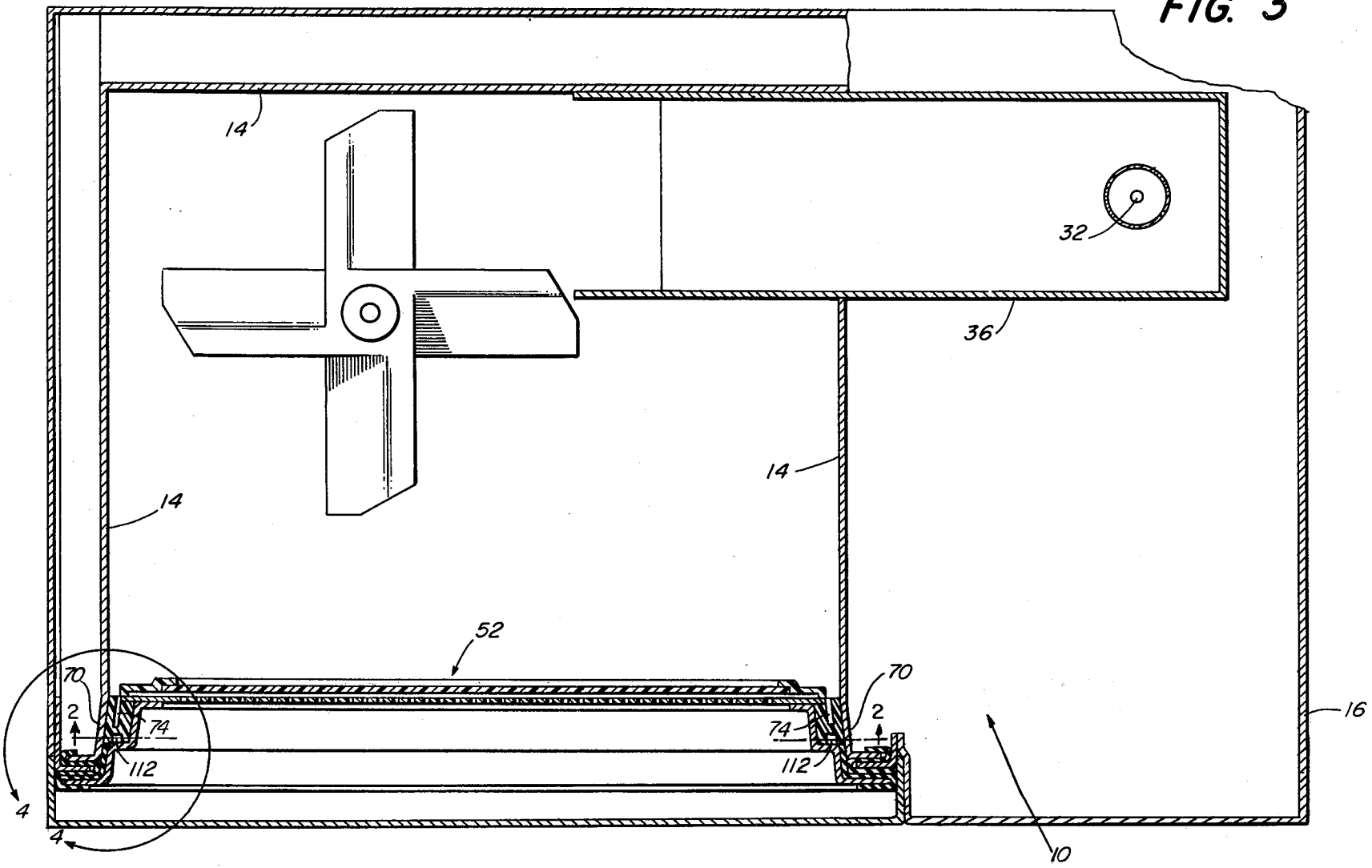
FIG. 3 is a longitudinal sectional view of the structure shown in FIGS. 1 and 2 taken along line 3—3 of FIG. 2.

Referring now to FIGS. 1 through 4, there is shown a microwave heating apparatus 10 comprising a hollow cavity 12 having interior walls 14 of conductive material, such as stainless steel aluminum or cold rolled steel, and a case member 16 surrounding the oven and having a front panel 18 with controls, such as timer switches and start-stop buttons 20.

Inside case 18 is a microwave generator 30, such as a magnetron, supplied with high voltage controlled by the electrical control circuits 18 and 20 which feeds energy via an output coupling 32 to a waveguide 36 coupled to the upper wall 14 of the oven 12. While the preferable frequency of the microwave generator is 2450 MHz, other frequencies may be used including the lower, or 915 MHz, band also authorized for microwave heating radiation by governmental standards. Energy is distributed cyclically in the oven by means of a mode stirrer 40 driven by a motor 42 to provide a cyclical varying pattern of resonant modes within the oven 12 to uniformly heat food bodies positioned in the oven.

Alternatively, and particularly if 915 MHz is used, a movable platform in the floor of the oven may be used to move the body to be heated in the oven through the resonant mode regions to produce uniform heating thereof.

An access aperture to the cavity 12 is covered by a door assembly 52 which, as shown, is hinged to the bottom of the oven by a metallic hinge 54 which in its open region supports the door together with arms 56 in its open position.

A latch 58 on door 52 actuates an interlock switch 60 through a hole 62 in the front of the oven outside cavity 12 when the door 52 is closed to permit operation of the oven. If the door is opened, for example a quarter of an inch or so, while the magnetron 30 is energized, the interlock switch 60 shuts off power to the magnetron 30 thereby deenergizing the oven in the event the door is accidentally opened prior to the end of the cooking cycle.

A microwave seal between the door 52 and the cavity walls 14 is formed by a structure comprising interior lip portion 70 of the oven cavity wall 14, which may or may not be slightly angled, for example, by 5° with respect to the wall portion 14 from which it extends, forms a peripheral conductive cavity wall region and one conductive portion of an input section 72 of a microwave seal. A metal wall 74 of the door 52 extends parallel to the wall 70 around the periphery of the oven and spaced therefrom by a sufficient distance to provide clearance when the door is shut with production tolerances between ovens. Such a spacing may be, for example, a tenth of an inch or a quarter of a centimeter.

Positioned in the space between walls 70 and 74 is a solid dielectric 76 which is a part of a dielectric block 80 of material such as polypropylene. As shown in greater detail in FIG. 1, the metal wall 74 contains slots 78 which extend the full length of the portion of wall 74 which is parallel to wall 70. The spacing of the slots is less than a quarter wavelength of the operating frequency in a direction around the periphery of the oven, and the width of the slots is substantially less than their spacing. The thickness of the dielectric member 76 may be slightly less than the gap spacing between the wall members 70 and 74 so that the remaining portion is filled with air. However, the major portion of the gap is preferably filled with a solid dielectric and eliminates any possibility of arcing between the wall members 70 and the metal wall 74. As a result, microwave energy which attempts to enter the input section of the seal at any angle having a peripheral component is prevented from propagating in the structure. For additional explanation of the slotted structure, reference may be had to the aforementioned U.S. Pat. No. 3,767,884 by John M. Osepchuk.

The block 80 has a portion 82 extending into a branch transmission line section 90 of the seal structure which is coupled to the input section 72 in a coupling region 92 beyond the end of the wall 74.

The effective electrical length of input section 72 from the cavity 12 to the coupling region 92 is preferably approximately a quarter wavelength of the microwave frequency of generator 30.

Branch line 90 extends back along the slotted wall 74 which forms one wall of the branch line 90 to an end plate 92 to which the wall 74 is attached. End plate 92 is electrically connected as, for example, by spot welding at 94 to a second die formed conductive member 96 which has a portion 98 extending from its region of contact with end plate 92 substantially parallel to the wall 74 for a distance beyond the end thereof, with the region between wall 74 and wall portion 98 being filled with dielectric 82. An extension of wall portion 98 is formed into a second end plate of line 90 parallel to the end plate 92 and extending beneath the end of the wall 74 to a point spaced from the cavity wall member 70 by a distance of, for example, 30 to 40 mils and then extends outwardly beyond the end of the wall 70 for a distance in excess of 100 mils and is attached to wall portion 102 which is formed parallel to a front surface 104 of the cavity. A layer of energy absorbing material 100 which may be, for example, a carbon loaded plastic is attached to the wall portion 102. The end of the cover 16 is formed with a member 106 parallel to the front of the oven between wall portions 102 and 106, and a second carbon loaded plastic layer 108 is positioned between the walls 102 and 106 Elements 100, 102, 104, 106 and 108 are formed on output transmission line section 110 of the microwave seal which is coupled to the input section 72 and branch section 90 in region 92. The end plate 98 of the branch line moves when the door is opened and preferably overlaps the portion 70 of the cavity wall for one-quarter to three-eighths of an inch as shown so that when the door is opened to a point where the interlock 60 will shut down the magnetron 30, the end plate will still be adjacent to the wall portion 70 and the effective electrical length of the input section 72 remains substantially constant.

It has been found that due to production tolerances in stamping jigs for integral part 96, 98 and 102 which, as shown, is integrally formed by die stamping from aluminum plate, and/or the slight shift in the frequency of the length of the input section due to the motion of the door with respect to the oven can cause the radiation leaking from the oven to exceed the permitted standard prior to opening of the interlock switch 60.

In accordance with this invention, a notch 112 is formed in the dielectric block 80 below the end of the wall 74. The size of notch 112 is selected to tune the system so that with the door 52 partially open to a point beyond which the interlock 60 will actuate, the electrical distance from the cavity end input section 72 to the shorted end plate 92 of the branch line 90 will be one-half wavelength at the microwave frequency of magnetron 30 so that the short circuit of the shorting plate 88 will be reflected along lines 90 and 72 to the cavity end of the input section 72. Such fine adjustment of length is preferable since microwave energy can propagate from the interior of the oven into the seal only in directions transverse to the seal periphery since propagation is inhibited in directions other than transverse to the seal because of the slots 78 and, hence, the input impedance to line 72 varies more rapidly with frequency than is the case without slots 78 and, hence, accurate dimensioning of the line becomes relatively critical.

Referring now to FIG. 5, there is shown a plot of the depth A of the notch 112 versus seal resonance frequency in megahertz for a system shown in FIGS. 1 through 4 which in the absence of the notch (notch depth A = 0) has the seal tuned for minimum radiation leakage with the frequency below 2400 MHz as shown by point 114 and is tuned to a frequency of 2550 MHz when the notch is approximately 5/32 of an inch deep as shown by point 114 and which has a frequency of 2600 MHz when the notch 112 has a depth of approximately 5/16 of an inch as shown by point 116. Hence, by selecting the depth of notch A, the desired frequency of 2450 MHz can be achieved by selecting a notch A depth of 1/8 to 3/16 of an inch as shown by point 118.

Preferably, notch 112 is positioned in the branch line 90 adjacent to coupling region 92 which is a region substantially a quarter wavelength from the shorting plate 88 and, hence, is a high impedance region of the seal structure where changes in the dielectric constant of the insulating medium will have a large tuning effect. A finger 150 of the dielectric remains to contact the end plate 98 to maintain the dielectric medium 80 rigidly positioned so that movement thereof which could change the tuning is minimized.

Referring now to FIG. 6, there is shown a structure similar to that in FIG. 4 except that the dielectric is formed as an insert 82 entirely within the branch guide and extension 132 of a plastic cover 130 which extends across the interior face of the oven door, covers the corner of the input section 72 and forms the solid portion of the dielectric between walls 70 and 74. Cover 130 as shown is formed preferably as an injection molding structure using, for example, polycarbonate material which presents a smooth easily cleanable surface for the oven door in the seal region so that the slots in the wall 74 are protected from food or other contaminants from the oven interior. A carbon loaded plastic layer 134 is used in the output section 110 of the seal between the oven front 140 and flange 102.

Referring now to FIG. 7, there is shown an embodiment of the invention wherein the carbon loaded plastic in the outer region or output section of the seal has been eliminated and a reactive output structure has been provided. In such an output structure, extensions 132 and 138 of the plastic oven cover 130 form the solid dielectric through the input and output sections 72 and 110 of the seal. The reactive seal comprises a metallic member 128 contacting the metallic door flange 102 and extending over the dielectric portion 138 to form a substantially quarter wavelength choke structure which joins to an air space between the plate 128 and the front end wall 140 of the oven face providing effectively a high impedance in series with the output section 110 of the seal. Such a high impedance reflects a low impedance to the output end of 110 hence, reduces leakage from the oven. Such a metal portion 128 may, if desired, extend completely around the oven periphery or may be positioned only in portions of the periphery where leakage from the oven is higher than the standards. For additional details of such a seal, reference may be had to the aforementioned related application of Richard D. Foerstner, Ser. No. 479,379. In general no such second choke 132 is required in regions of the door hinge since the hinge acts as a shorting plate to inhibit the leakage of microwave energy. An outer oven door cover 142 which is preferably a die molded plastic, is attached to the assembly by means of screws to hold the plastic inner cover to the outer door cover.

Description of the Preferred Process for Forming the Microwave Oven

In order to form the microwave oven, the interior walls of the oven are preferably formed by spot welding sheet metal together with spot welds substantially less than a half wavelength apart so that energy is prevented from propagating out the cracks between the welds. The door is preferably formed by die stamping a door wall member from aluminum plate into a configuration having a branch choke wall and an end face wall. A sheet metal slotted wall member for a common wall between the input and branch transmission lines is formed by stamping slots in the periphery of the sheet metal, forming the resulting metal fingers in a direction perpendicular to the plane of the sheet metal member and spot welding the sheet metal member to the aluminum plate stamping to form the branch line 90 with dielectric 80 positioned in the branch guide prior to the spot welding. The depth of notch 110 formed in the plastic body 80 may be altered between production runs, dependent on the frequency adjustment required for the microwave seal due, for example, to the wear of the stamping dies.

In the structure of FIG. 7, a plastic cover is injection molded and positioned over the assembly and held on by the metal members 132 which form the branch line reactive load. Microwave source energy control module mode stirrer and associated parts are assembled within the cabinet and the assembly production tested for microwave energy leakage and other faults.

This completes the description of the embodiments of the invention illustrated herein. However, many modifications thereof will be apparent to persons skilled in the art without departing from the spirit and scope of this invention. For example, solid dielectrics having different dielectric constants from polypropylene could be used to fill the notch in the dielectric material in the branch guide to lower the seal frequency. Accordingly, it is contemplated that this invention be not limited to the particular details illustrated herein except as defined by the appended claims.

What is claimed is:

1. In a microwave oven excited with microwave energy of a predetermined frequency having an oven wall region providing an access aperture closed by a door and having a microwave energy seal for preventing leakage of microwave energy through the space between peripheral regions of said aperture and peripheral regions of said door;

said seal having an input transmission line section and a choke section coupled to said input section, said input section comprising conductive portions of said wall oven spaced from conductive portions of said door by a dielectric medium comprising a solid dielectric having a dielectric constant substantially greater than unity and with said choke section comprising conductive portions of said door substantially enclosing a dielectric medium comprising a solid whose dielectric constant is substantially greater than unity;

the improvement comprising:

said choke section being formed with dimensions which would resonate at a frequency below said predetermined frequency of said oven if said choke were filled with said solid dielectric;

a portion of said solid dielectric being omitted in a tuning region adjacent said coupling region to provide an average dielectric constant in said tuning region which is lower than the dielectric constant of the major portions of said choke section dielectric medium; and the size of said omitted dielectric portion being selected to resonate said choke section substantially at said predetermined microwave oven excitation frequency.

2. The microwave oven in accordance with claim 1 wherein said input section comprises means for inhibiting the propagation of energy at said frequency peripherally around said door.

3. The microwave oven in accordance with claim 2 wherein said inhibiting means comprises impedance discontinuities in said input section.

4. The microwave oven in accordance with claim 3 wherein said impedance discontinuities comprise slots in a common wall between said input line and said choke section.

5. The microwave oven in accordance with claim 1 wherein said choke section has a substantial short circuit at a distance from the region of coupling to said input line which is substantially a quarter wavelength of said frequency and said region of lower dielectric constant is adjacent said coupling region.

6. In a microwave oven having a cavity whose interior dimensions are greater than a plurality of free space wavelengths at the frequency of the microwave energy supplied to said cavity by a microwave energy generator, a door closing an access aperture to said oven cavity and a door position sensor for controlling said microwave energy generator for deenergizing said generator when said door is opened during operation of said generator, the improvement comprising:

a microwave energy seal between said door and cavity wall surrounding said aperture and having means for inhibiting the excitation from said cavity of transmission of microwave energy in said seal at said frequency around the periphery of said door said seal comprising conductive portions of the periphery of said door and conductive portions of a wall region surrounding said aperture separated by a dielectric medium comprising a solid dielectric having a dielectric constant substantially greater than unity to form an input seal section extending between the interior of said oven and a region of coupling to a choke section and to an output transmission line section each coupled to said input section in said coupling region having a dielectric medium comprising a solid whose dielectric constant is substantially greater than unity in a tuning region adjacent said coupling;

an average dielectric constant being lower than the dielectric constant of the major portion of said choke section dielectric medium and with said choke section having its effective electrical wavelength selected by selection of a coupling region dielectric constant to reflect a substantial short circuit to the cavity end of said input section when said door is opened to a point beyond which said door position sensor deenergizes said microwave energy generator.

7. The microwave oven in accordance with claim 6 wherein said branch section has an effective electrical length of substantially a quarter wavelength of the frequency of energy produced by said microwave generator.

8. The microwave oven in accordance with claim 6 wherein a solid dielectric cover for a surface of said door is die formed integrally with solid dielectric portions of the input and output sections of said seal.

9. The microwave oven in accordance with claim 6 wherein said output section contains a microwave energy absorber.

10. A microwave oven in accordance with claim 6 wherein said output section comprises a solid dielectric and conductive wall regions coupled to reactive impedance load means for reflecting microwave energy back to said input section of said seal.

11. The method of reducing microwave energy radiation from a microwave oven which is excited with microwave energy of a predetermined frequency which has an access aperture closed by a closure member and which has a microwave energy seal between the peripheral regions of said aperture and closure member comprising:

forming said seal with an input transmission line section defined by conductive portions of said oven wall spaced from conductive portions of said door by a dielectric medium comprising a solid dielectric having a dielectric constant substantially greater than unity and a branch transmission line section coupled to said input section in a region having an average dielectric constant of the dielectric medium whose value is selected to be lower than the average value of the dielectric constant of said branch line to effectively tune said seal structure to a frequency band including said predetermined frequency when said door is fully closed as well as when said door has been moved by a predetermined amount sufficient to operate a switch deenergizing said source of microwave energy.

12. The method in accordance with claim 11 wherein said input section has a slotted wall.

13. The method in accordance with claim 12 wherein said slotted wall also forms a wall of said branch transmission line section.

* * * * *